United States Patent [19]

Waddell

[11] 3,932,110

[45] Jan. 13, 1976

[54] INTERVANE BURNERS

[75] Inventor: Alistair Tobias Waddell, Larbert, Scotland

[73] Assignee: Foster Wheeler Energy Corporation, Livingston, N.J.

[22] Filed: Sept. 12, 1974

[21] Appl. No.: 505,283

[52] U.S. Cl. ..... 431/184; 239/402.5

[51] Int. Cl.[2] ..... F23M 9/00

[58] Field of Search ..... 431/184; 239/402.5, 407, 239/503, 513, 399

[56] References Cited

UNITED STATES PATENTS

| | | | |
|---|---|---|---|
| 2,144,098 | 1/1939 | Baker | 431/184 |
| 3,145,670 | 8/1964 | Copiah et al. | 431/184 |
| 3,720,495 | 3/1973 | Zink et al. | 431/184 |

*Primary Examiner*—Edward G. Favors
*Attorney, Agent, or Firm*—John P. De Luca; Marvin A. Naigur; John E. Wilson

[57] ABSTRACT

An apparatus comprising a number of rotatable vanes, situated around the periphery of an annular duct, which can be opened and closed so as to control the flow of gas entering the duct. The axis of rotation of the vanes is parallel with the axis of the duct. The vanes are divided into groups, each vane of a group being connected to another vane of that group and each group of vanes being connected to a common drive means so that rotation of the drive means causes the vanes to open or close in unison.

5 Claims, 5 Drawing Figures

INTERVANE BURNERS

This invention relates to an apparatus for controlling the flow of gas entering an annular duct. More particularly it relates to an apparatus containing vanes which are capable of being rotated about axes parallel to the axis of an annular duct to control the amount of gas entering the duct, the axes of the vanes being angularly evenly spaced around the periphery of a circle whose axis is coincident with the axis of the annular duct, the vanes being arranged to cause the gas to follow a swirling path in the duct. Such an apparatus may, for example, be used to control the flow of secondary air entering certain types of burner.

BACKGROUND OF THE INVENTION

An apparatus for controlling the flow of gas entering an annular duct may comprise a plurality of vanes mechanically linked to one another so that the vanes can all be opened or closed in unison by rotating a single drive shaft linked to one of the vanes. By rotating the vanes it is possible to allow a controlled amount of gas to enter the annular duct and to cause the gas which passes over them to follow a swirling path in the duct. When the apparatus is used to control the flow of air passing into a burner the production of a swirling motion helps to ensure a satisfactory mixing of the air and fuel; and efficient combustion and elimination of undersirable gaseous pollutants results.

The problem inherent in existing apparatus of this type is excessive tightness in or jamming of, the vanes this is a direct result of their excessive free motion resulting from the fact that each vane is mechanically operated by an adjacent vane, this mechanical operating of each vane by an adjacent vane occuring right the way round the circle of vanes. The problem is made more acute by distortion of the front plate supporting the vanes. The jamming causes damage to the gearbox controlling the drive shaft and shearing of the drive shaft shear pins. Attempts to overcome the problem have so far been unsuccessful.

BRIEF SUMMARY OF THE INVENTION

According to the invention there is provided an apparatus for controlling the flow of gas entering an annular duct, which apparatus comprises: a plurality of vanes capable of being rotated about an axis parallel to the axis of the annular duct to control the amount of gas entering the duct wherein;

a. the axis of the vanes are angularly evenly spaced around the periphery of a circle whose axis is coincident with the axis of the annular duct;
b. the vanes are arranged to cause the gas which passes over them to follow a swirling path in the duct.
c. the vanes are divided into groups of one or more vanes, which groups are mechanically linked to a common drive means and,
d. the vanes of each group are mechanically linked to one another so that rotation of the drive means causes the vanes to open or close in unison.

The invention allows the above-mentioned problem to be mitigated since the drive to each vane is more direct. The free motion of the vanes is reduced and slight distortion of the front plate does not result in jamming of the vanes since the rotation of each vane is not dependent upon the free movement and correct alignment of all the vanes in the apparatus. The free motion is dependent only on a proportion, depending on the number of groups, of the vanes. Furthermore, the apparatus of the invention is simple and existing apparatus can be modified relatively easily.

In a preferred embodiment of the invention the groups of vanes are mechanically linked to the common drive means by sets of levers connected to a drive shaft attached to a single vane of each group. If the drive shaft is attached to the central vane of each group the directness of the drive to each vane can be increased even more. The common drive means may be a drive shaft connected to the central vane of one of the other groups.

There may, for example, be three groups of vanes and in this case the movement of each vane will depend only on the correct alignment of one-third of the total number of vanes. Distrotion of the front plate is less likely, therefore, to effect the case of rotation of the vanes.

The set of levers connecting the common drive means with the groups of vanes may take the form of a lever fixed to the main drive shaft and pivotably attached to one end of a connecting rod the other end of which rod is pivotably attached to a lever fixed to the end of the drive shaft which is attached to the central vane of a group.

Preferably each connecting rod has means for adjusting its length, such as a turn buckle, and the ends of the connecting rod are linked to the levers via clevises to avoid any bending movement at the joints.

The apparatus of the invention may be used to control the flow of gases, such as secondary air, into a burner provided with heat exchange tubes for generating vapours.

BRIEF DESCRIPTION OF THE DRAWINGS

The invention will now be illustrated by way of example with reference to the accompanying drawings in which.

Figure 1:
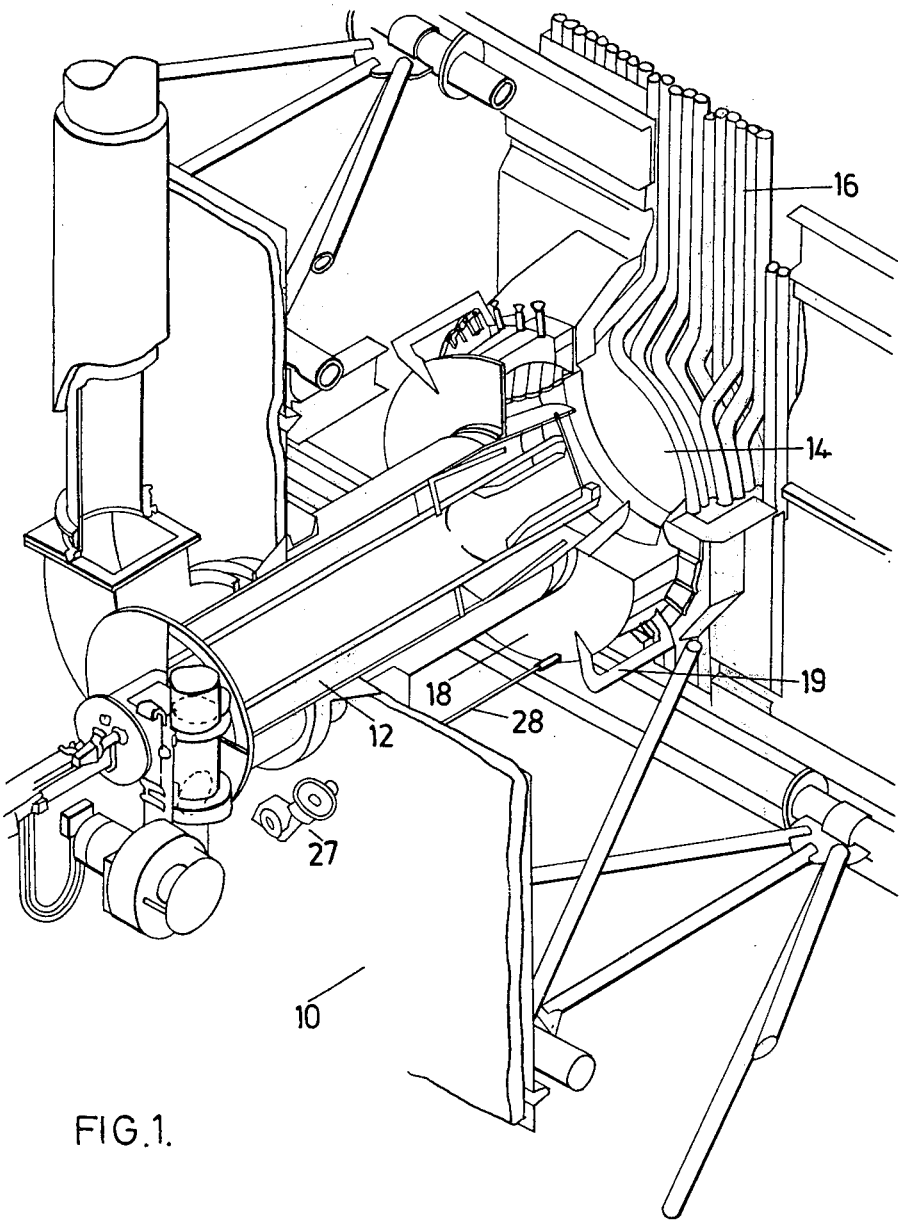
FIG. 1 is a perspective view of a burner containing a conventional apparatus for controlling air flow into a cylindrical duct.

The burner 10 shown in FIG. 1 comprises a fuel duct 12 through which fuel etc is passed to the combustion chamber 14. Surrounding this chamber 14 are tubes 16 in which vapour is generated by heat exchange between the fluids in the tubes and the hot gasses produced in the chamber. Steam, for example, may be produced. At one end of the combustion chamber 14 and surrounding the end of the fuel duct 12 is an apparatus 18 for controlling secondary air flow into the chamber 14.

Figure 2:
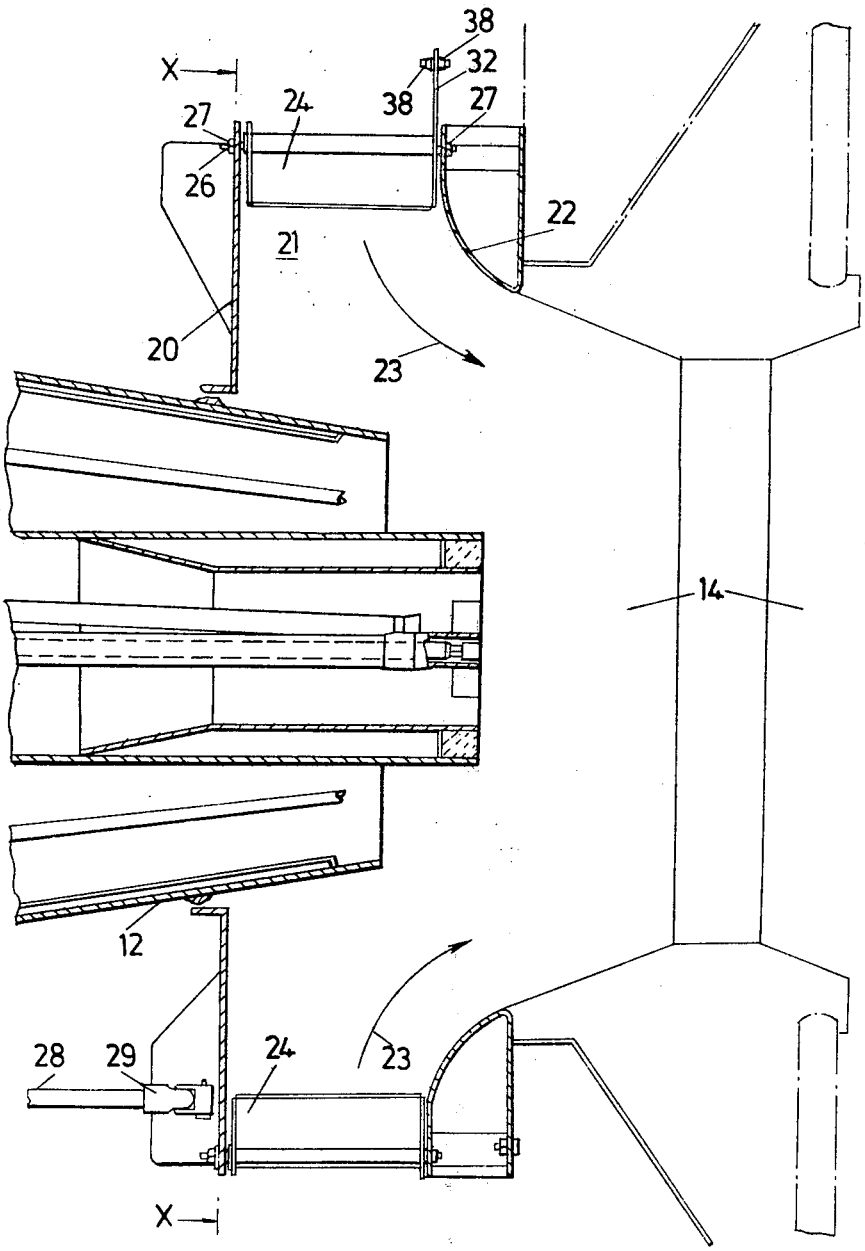
FIG. 2 is a vertical section through the apparatus shown in FIG. 1.
Figure 3:
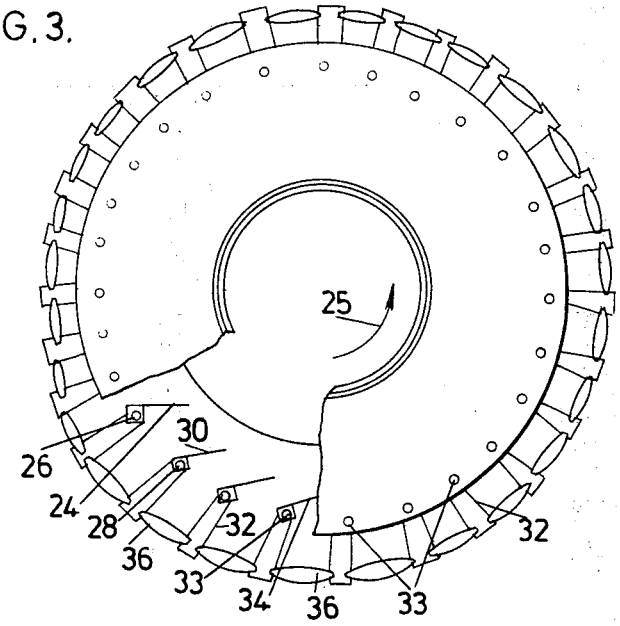
FIG. 3 is a section taken along the line X—X of FIG. 2 with the fuel duct removed and part of the front plate cut away.

The apparatus 18 shown in FIGS. 1 to 3 is of conventional design and comprises a circular front plate 20 positioned around the fuel duct 12. The front plate 20, together with a back plate 22, define an annular duct 21 for the secondary air the direction of flow of which is indicated by the arrows 23 (FIG. 2) and arrow 25

(FIG. 3). The apparatus 13 is strengthened by stiffeners 19.

A plurality of vanes 24 are arranged in a circular manner about the fuel duct 12 and are supported on pivots 26 secured to the front plate 20 and back plate 22 by nuts 27.

In a conventional apparatus a single drive shaft 28 is attached to a vane 30, and the vane 30 (FIG. 3) is linked to all the other vanes 24 of the apparatus by means of levers 32 pivoted at 34 to pairs of linking arms 36. The end of each lever 32 has four pivot points 38 for attachment to the linking arms which are arranged in pairs.

Rotation of the drive shaft 28, operated by an actuator 27 and containing a universal coupling 29, causes the vane 30 to rotate which in turn causes the other vanes 24 of the apparatus to rotate.

The vanes 24 and vane 30, of which there may be for example 34, can be closed or opened by rotation of the vanes about their pivots 26 to allow a controlled amount of secondary air to enter the circular duct 21 evenly right the way round the periphery of the apparatus 18, the gas, as it enters the duct 21 being caused to follow a swirling path in the duct. Owing to the free motion of the vanes 24 and 30 and the fact each one is mechanically operated by an adjacent vane any distortion of the front plate 20 produces tightness and makes the vanes 24 and 30 difficult to rotate.

Figure 4:
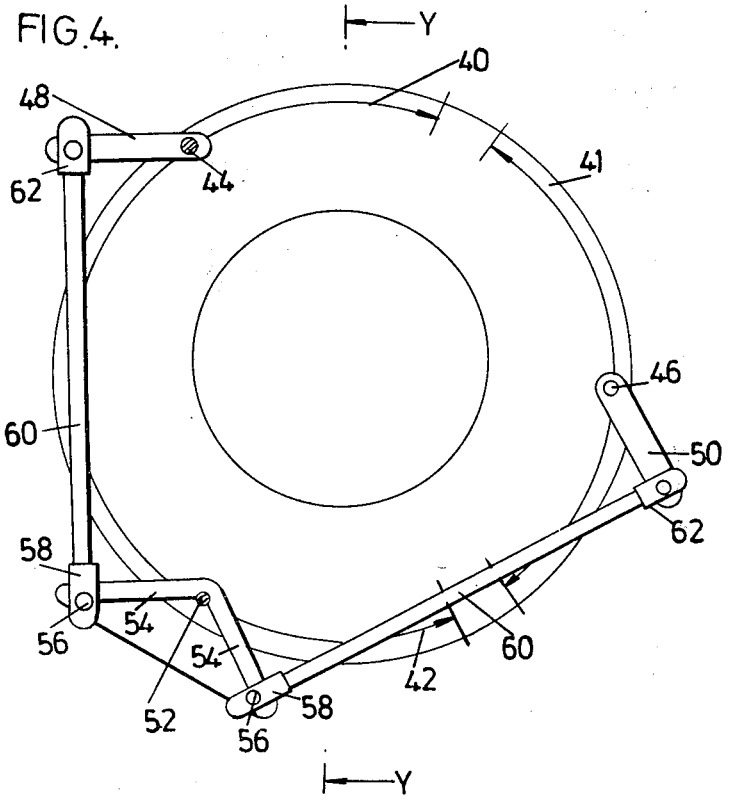
FIG. 4 is an end view of the apparatus shown in FIGS. 1 to 3 but modified in accordance with the invention.
Figure 5:
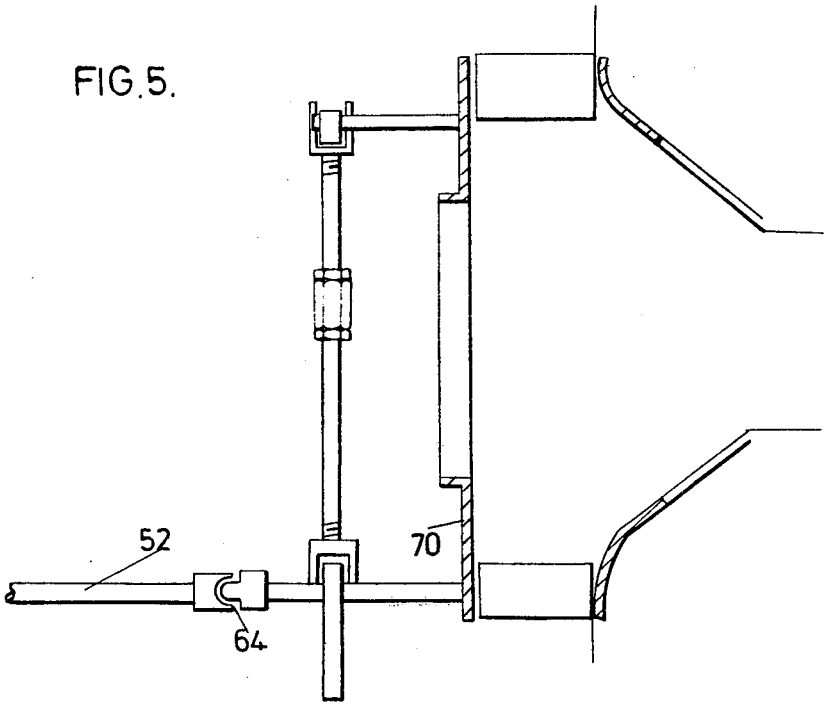
FIG. 5 is a section taken along the line Y—Y of FIG. 4 with the fuel duct removed.

The invention provides a modified apparatus as shown in FIGS. 4 and 5 which substantially overcomes these problems. The apparatus of the invention has its vanes divided into three groups 40, 41 and 42. The vanes of each group are linked to one another by arms 32 and linkes 36, as shown in FIG. 3, so that rotation of any one vane results in rotation of the other vanes in its group.

The two groups 40 and 41 are provided with drive shafts 44 and 46 respectively, and each drive shaft is attached to a lever 43 and 50 respectively. The group 42 is provided with a main drive shaft 52 to which are attached two integral levers 54. Each of the levers 54 is pivoted at 56 to a clevis 58 screwed onto the threaded end of a shaft 60. The opposite end of the shaft 60 is threaded and screwed onto a clevis 62 which is pivoted on the arms 48 and 50.

The drive shaft 52 has a universal coupling 64 and rotation of the drive shaft 52 causes the vanes of group 42 to open or close depending on the direction of rotation. The rotational movement is transmitted via the levers 54, rods 60 and arms 48 and 50 to the drive shafts 44 and 46 which results in rotation of the vanes of groups 40 and 41. All the vanes thus rotate in unison.

The drive to each of the vanes is more direct than is the case with the existing apparatus, thus tightening and jamming of the vanes is avoided, even when the front plate 20 is slightly distorted.

Existing apparatus can readily be modified and it will usually be necessary to reposition the existing universal coupling 29 to accomodate the new levers 54 on the drive shaft 52 so as to keep the levers clear of the stiffeners 19.

What I claim is:

1. An apparatus for controlling the flow of gas entering an annular duct wherein a plurality of vanes are rotatably mounted between front and rear walls of the duct about an axis parallel to the axis of the annular duct to control the amount of gas entering the duct when actuated, each vane being angularly evenly spaced around the periphery of a circle whose axis is coincident with the axis of the annular duct and arranged to cause the gas which passes over them to follow a swirling path in the duct, the improvement comprising:

an arrangement of the vanes into three groups of vanes, means for mechanically interconnecting the vanes of each group to one another so that actuation of one of said vanes causes the vanes of the group to open and close in unison;

a single drive shaft connected to one vane of each group, a mechanical linkage means coupling the drive shaft of each group of vanes so as to operate same in unison, common drive means coupled to the mechanical linkage for actuating same thereby operating all the groups of vanes in unison.

2. The apparatus as described in claim 1 wherein the common drive means is linked to three groups of vanes which are arranged to operate at angles of approximately 120° about the circle.

3. The apparatus described in claim 1 wherein the common drive means is coupled to the drive shaft of one of said groups and the linkage means comprises: a lever attached to the drive shaft of each of the remaining groups and a shaft pivoted at each end connecting the lever and the common drive means such that actuation of the common drive means actuates the other drive shafts.

4. The apparatus as described in claim 3 wherein the common drive means includes a drive lever fixed to the shaft having a triangular geometry, the drive shaft of the group coupled to a vertex point of said lever and the levers of the two remaining groups are coupled, one each to the vertices of the drive lever through the pivoted shafts, and wherein the remote shaft levers extend generally in a tangential direction generally parallel to edges of the triangular drive lever relative to the vertex coupled to the first mentioned group.

5. The apparatus according to claim 3 wherein the mechanical connections coupling the fixed end drive levers through said pivoted shafts are affected by clevises.

* * * * *